United States Patent [19]

McGourty

[11] 4,322,608

[45] Mar. 30, 1982

[54] METRIC-ENGLISH MEASUREMENT COMPARATOR DEVICE

[76] Inventor: Thomas K. McGourty, Adelaida Rte., Paso Robles, Calif. 93446

[21] Appl. No.: 215,671

[22] Filed: Dec. 12, 1980

[51] Int. Cl.[3] ..... G06C 3/00

[52] U.S. Cl. ..... 235/85 R; 235/88 R

[58] Field of Search ..... 235/70 R, 70 A, 61 GM, 235/66, 71 A, 79.5, 78 R, 78 M, 86, 85 R, 88 R, 88 M, 83, 84, 77, 88 FC–87 A, 88 F, 88 G, 88 N, 88 RC, 89 R; 33/137 R, 138–140

[56] References Cited

U.S. PATENT DOCUMENTS

| | | | |
|---|---|---|---|
| 1,928,377 | 9/1933 | Hobbs | 235/66 |
| 2,569,295 | 9/1951 | De Witt | 235/61 GM |
| 3,698,630 | 10/1972 | Dick et al. | 235/84 X |
| 3,757,092 | 9/1973 | Miller | 235/78 R X |
| 3,790,074 | 2/1974 | Zemanell et al. | 235/70 A X |
| 3,795,795 | 5/1974 | Gulbransen, Jr. | 235/70 A |
| 3,837,569 | 9/1974 | Bradbury et al. | 235/70 R |

*Primary Examiner*—Monroe H. Hayes
*Assistant Examiner*—Benjamin R. Fuller
*Attorney, Agent, or Firm*—Fred N. Schwend

[57] ABSTRACT

A device for converting between the metric and English systems of measurement including a circular scale disc having concentric scales on one side graduated according to the English system and correlated concentric scales on the opposite sides graduated according to the metric system. A pivoted cursor straddles both sides of the device and has index windows through which related English system and metric system measurements may be read, the scales being correlated so that one index window exhibits an amount according to the English system and the other exhibits a corresponding amount according to the metric system. Certain scales in the metric system have dual functions. A measuring tape is received in a cavity formed in two facing side discs and is moveable endwise in slots formed in the side discs, the tape being marked off according to both the English and the metric system.

7 Claims, 9 Drawing Figures

METRIC-ENGLISH MEASUREMENT COMPARATOR DEVICE

BACKGROUND OF THE INVENTION

1. Field of the Invention

This invention relates to devices for converting from one system of measurement to another and has particular reference to a device for converting between various measurements in the metric system and corresponding measurements in the English system.

2. Description of the Prior Art

The increasing use of the metric system of measurement in the United States has created a hardship on persons who have heretofore been accustomed soley to measurements in the English system.

Various devices have been proposed heretofore for computing the metric equivalent of measurements specified according to the Engish system and vice-versa so that persons may relate such measurements to a system with which they are acquainted. However, such devices, to my knowledge, have proved difficult to understand and use. In order to provide for the conversion of measurements of various kinds, such as distance, weight, volume, and temperature, a large number of scales are usually required, which also, in order to obtain a desired amount of accuracy, results in a bulky and cumbersome device.

SUMMARY OF THE INVENTION

A principal object to the present invention is to provide a small compact device having a high degree of accuracy for converting measurements between the metric system and the English system.

Another object is to provide a device of the above type which can readily convert between the metric system and the English system at a glance, with a minimum amount of adjustment and without mental calculation.

Another object is to provide a device of the above type which can, with equal facility, convert from the English system to the metric system and from the metric system to the English system.

A further object is to provide a device of the above type which is extremely easy to use and accurate and which can be carried in ones pocket.

According to the present invention, a metric-English converting device is provided comprising a scale disc having a series of concentric circular scales on one side graduated in accordance with the English system of measurement and having a fewer number of concentric circular scales on the opposite side graduated in accordance with the metric system. A pivoted cursor straddles both sides of the disc, enabling the user to set the cursor to indicate a measurement in either the metric or English system on one side while indicating the corresponding measurement in the other system on the opposite side. The scales are so correlated that those in the metric system perform dual functions so that fewer scales are necessary. The scales are protected by transparent side discs which also jointly form a central cavity to receive a spirally wound linear tape measure on which linear dimensions are marked in both the metric and the English system.

BRIEF DESCRIPTION OF THE DRAWINGS

The manner in which the above and other objects of the invention are accomplished will be readily understood in reference to the following specification when read in conjunction with the accompanying drawings, wherein.

DESCRIPTION OF THE PREFERRED EMBODIMENT

Figure 1:
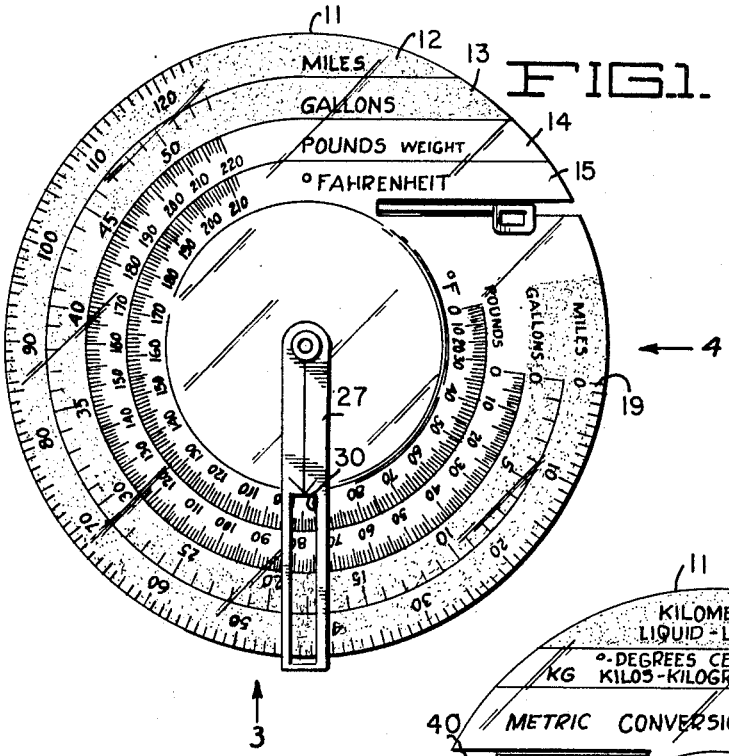
FIG. 1 is a side view of a metric-English measurement converting or comparing device emboding a preferred form of the present invention.

Although this invention is susceptible of embodiment in many different forms, there is shown in the drawings and will be described a specific embodiment, with the understanding that the present disclosure is to be considered as an exemplification of the principles of the invention and is not intended to limit the invention to the embodiment illustrated. The scope of the invention will be pointed out in the appended claims.

Figure 2:
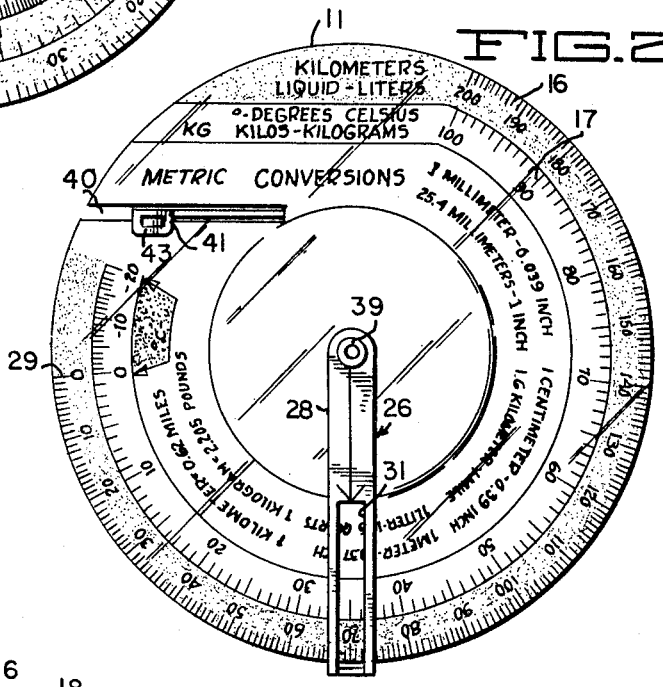
FIG. 2 is an opposite side view of the device.
Figure 3:
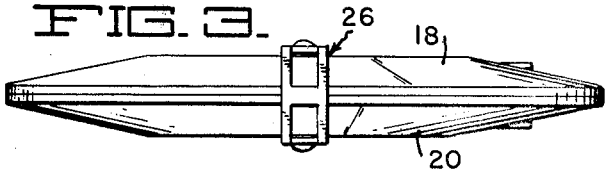
FIG. 3 is an edge view of the device and is taken in the direction of the arrow 3 of FIG. 1.
Figure 4:
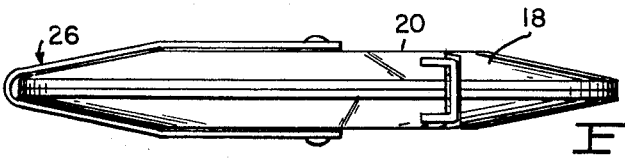
FIG. 4 is another edge view of the device and is taken in the direction of the arrow 4 of FIG. 1.

Referring to the drawings, the device comprises an annular scale disc 11 of paper or the like, having on one side (as shown in FIG. 1) four concentric circular scales 12, 13, 14, and 15 printed thereon. Such scales are graduated according to the English system of measurement, in miles, gallons, pounds, and degrees Fahrenheit, respectively. It should be noted that all such scales progress clockwise from zero reference marks, i.e. 19. On the opposite side of the scale disc 11 (as shown in FIG. 2) two concentric circular scales 16 and 17 are printed. These are graduated according to the metric system of measurement in kilometers-liters and degrees Celsius-kilograms, respectively. The latter scales progress counter-clockwise from zero reference marks, i.e. 29.

The scale disc 11 is fitted between two similar side discs 18 and 20 preferably formed of transparent plastic. A thin annular lip 21 is formed on the disc 18 to receive the scale disc 11 and to locate the same in proper concentric relation to the side discs.

Figure 6:
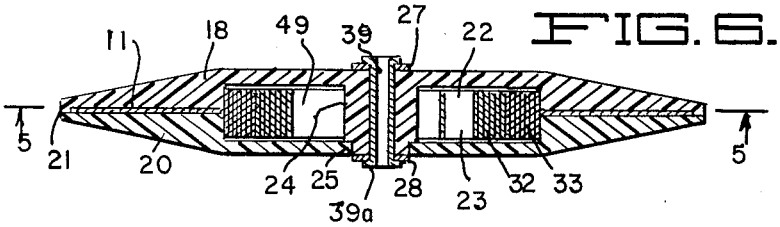
FIG. 6 is a transverse sectional view taken along line 6—6 of FIG. 5.

The discs 18 and 20 are relatively thick at their central sections and taper radially outwardly to a relatively thin rim. Facing annular bores 22 and 23 are formed in the side discs 18 and 20, respectively, to form a central cavity 49 and a hollow hub 24 is formed on the disc 18 to extend into such cavity. The hub 24 is located eccentrically of the coincident axes of the discs 11, 18, and 20. The hub has a reduced diameter section 25 at its lower end, FIG. 6, to fit within a mating opening in the disc 20 to maintain both discs 18 and 20 co-axial relationship.

A U-shaped cursor 26, having two spaced arms 27 and 28, straddles the side discs 18 and 20. The cursor is pivoted on a pivot eyelet 30 extending through the hub 24, concentrically the discs 11, 18, and 20. The eyelet 39 is headed its opposite ends as indicated at 39a to retain the parts of the device in assembled condition.

The arms 27 and 28 have index windows 30 and 31, respectively, formed therein, through which underlying indices on the various scales may be read to convert between the metric system and the English system.

Figure 5:
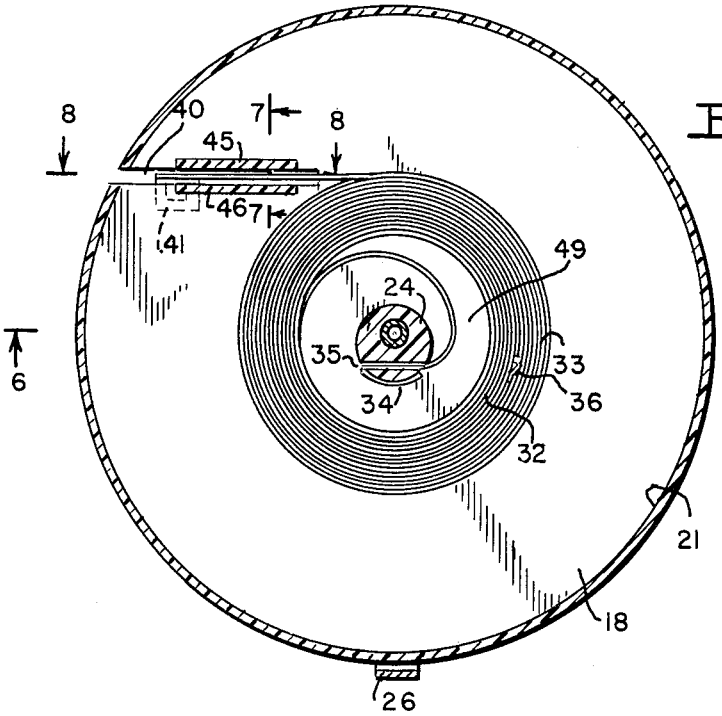
FIG. 5 is a transverse sectional view taken along the line 5—5 of FIG. 6.
Figure 9:
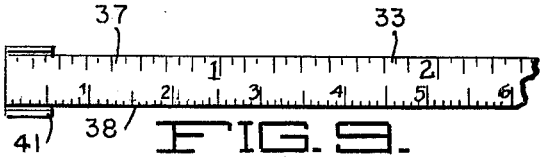
FIG. 9 is a view showing part of the linear measuring and comparing tape.

The cavity 49 receives a spirally wound clock-type spring 32 and an elongate thin metal measuring tape 33. The spring 32 is bent upon itself at one end, as indicated at 34 in FIG. 5, and is received in a slot 35 formed in the hub 24 to anchor such end. The opposite end of the spring 32 is suitably attached at 36 to the inner end of the tape 33 and normally retains the tape in a spirally wound condition within the cavity 49 (as shown in FIG. 5). Such tape 33, as seen in FIG. 9, has a first linear scale 37 marked off in inches and a second scale 38 marked off in millimeters and centimeters. Both progress from the left hand end of the scale.

The outer end of the tape 33 is slideable endwise through a pair of aligned slots 40 formed in the side discs 18 and 20. The slots 40 extend tangentially of the bores 22 and 23 and open to the peripheries of both discs.

A U-shaped tab 41 is suitably attached to the outer end of the tape 33 and forms ears 42 and 43 which fit against opposite sides of the side discs 18 and 20 when the tape is withdrawn into the device to facilitate grasping of the outer end of the tape.

Figure 8:
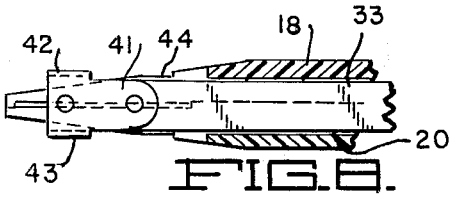
FIG. 8 is a fragmentary sectional view taken along line 8—8 of FIG. 5.

The spring 32 tends to draw the tape into the cavity 49 while tab 41 prevents the tape from being completely retracted through the slots 40. When fully retracted past its position shown in FIG. 8, ears 42 and 43 slide over cut-out portions of 44 in the discs 18 and 20 so that such ears will not tend to catch on the user's clothing when placed in a clothes pocket.

Figure 7:
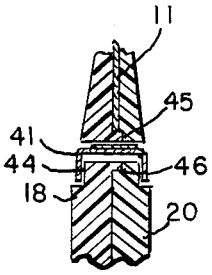
FIG. 7 is a fragmentary transverse sectional view taken along line 7—7 of FIG. 5.

Location tongues 45 and 46, FIGS. 5 and 7, are formed on the side disc 18 and to be received in mating grooves in the side disc 20 when the discs are assembled to properly orient such discs relative to each other and to properly orient the scale disc 11. Thus, the various parts of the device may be readily assembled in properly orientated positions with a minimum amount of time and effort.

To facilate correlation between the scales of opposite sides of the scale disc, the outer kilometers-liters scale 16 and the two outer miles and gallons scales 12 and 13, respectively, are colored distinctively from the remaining scales, as indicated by stipling of such scales 12, 13, and 16.

In operation, if for example, it is desired to convert 43½ miles into kilometers, the cursor 26 is rotated until the value "43½" on the English scale 12 is visible through the index window 30, as indicated in FIG. 1. Then, by merely viewing through the index window 31 on the opposite or metric scale side in FIG. 2, the value "70" kilometers may be read. Obviously, the reverse procedure may be followed to convert from kilometers to miles.

In order to assist in quickly and readily locating the proper scales, the user need merely refer to the scale of similar color on opposite sides of the scale disc.

In another example, if it is desired to convert 18½ gallons to liters, the cursor 26 is rotated until the value "18½" is visible through the index window on the scale 13 and the value "70" liters will be indicated on the scale 16.

To convert 35 kilograms to pounds, the cursor 26 is rotated to indicate "35" on the metric scale 17 and the corresponding value of "77" pounds as indicated on the English scale 14.

To convert 95 degrees Fahrenheit to degrees Celsius, the cursor 26 is rotated to indicate "95" on the English scale 15 and the corresponding value of "35" degrees Celcius will be indicated on the metric scale 17.

In using the tape 33, the latter may be withdrawn to directly measure a desired distance which may be then read off on scale 37 in inches in accordance with the English system or it may be read off on scale 38 in millimeters and centimeters in accordance with the metric system. Also, in order to convert between dimensions in the metric system and in the English system, the tape may be withdrawn until the proper measurement is indicated on one or the other of the scales 37 and 38 and the corresponding value in the other system may be noted directly across the scale.

I claim:

1. A device for converting between the metric and the English system of measurement, which comprises a scale having a first circular scale on one side graduated according to a metric system of measurement and a second circular scale on the opposite side correlated with said first scale and graduated according to the corresponding English system of measurement, said scales being coaxial with each other, a U-shaped cursor straddling said sides of said scale disc, means supporting said cursor for pivotal movement about the axes of said scales, said cursor having a first index means moveable over said first scale and a second index means moveable over said second scale whereby positioning of one of said index means to indicate a measurement in one of said systems will cause the other of said index means to indicate a corresponding measurement in the other of said systems, a third circular scale on said opposite side graduated according to a second English system of measurement, said third scale being correlated with said first scale whereby positioning of said second index means to indicate a measurement according to said second English system will cause said first index means to indicate a measurement in the corresponding metric system on said first scale.

2. A device as defined in claim 1 wherein said first scale is graduated according to kilometers and said second scale is graduated according to miles.

3. A device as defined in claim 1 wherein said first scale is graduated according to kilometers and liters and said second scale is graduated according to miles and said third scale is graduated according to gallons.

4. A device as defined in claim 1 comprising transparent side discs on opposite sides of said scale disc, said side discs having facing bores therein, slots extending from said bores to the peripheries of said side discs, and a spirally wound measuring tape fitting in said bores and extendable through said slots, said tape being graduated according to both metric and English systems of measurement.

5. A device as defined in claim 4 comprising an elongate spirally wound spring attached at one end to said tape and anchored at the opposite end thereof to one of said side discs.

6. A device as defined in claim 5 comprising a hub on one of said side discs extending through said bores and fitting in an opening in the other said side discs, an opening extending through said hub, and a pivot element for said cursor extending through said opening in said hub, said pivot element retaining said discs and said cursor in assembled relationship.

7. A device as defined in claim 6 comprising means on said hub for anchoring said opposite end of said spring to said one of said side discs.

* * * * *